US008665037B2

(12) United States Patent
Nicotra

(10) Patent No.: US 8,665,037 B2
(45) Date of Patent: Mar. 4, 2014

(54) CROSS POLARIZATION MULTIPLEXER FORMED IN A MONOBLOCK BODY

(75) Inventor: Sebastiano Nicotra, Alcalá de Henares (ES)

(73) Assignee: Ferox Communications, S.L., Madrid (ES)

( * ) Notice: Subject to any disclaimer, the term of this patent is extended or adjusted under 35 U.S.C. 154(b) by 0 days.

(21) Appl. No.: 13/282,813

(22) Filed: Oct. 27, 2011

(65) Prior Publication Data

US 2012/0105171 A1 May 3, 2012

Related U.S. Application Data

(63) Continuation of application No. PCT/ES2010/070192, filed on Mar. 30, 2010.

(30) Foreign Application Priority Data

Apr. 28, 2009 (ES) ..... 200901105

(51) Int. Cl.
*H01P 1/161* (2006.01)

(52) U.S. Cl.
USPC ..... 333/137; 333/21 A

(58) Field of Classification Search
USPC ..... 333/122, 135, 137, 21 A, 21 R
See application file for complete search history.

(56) References Cited

U.S. PATENT DOCUMENTS

| | | | | | |
|---|---|---|---|---|---|
| 4,047,128 | A * | 9/1977 | Morz | 333/122 |
| 4,491,810 | A | 1/1985 | Saad | |
| 4,912,436 | A * | 3/1990 | Alford et al. | 333/135 |
| 4,920,351 | A * | 4/1990 | Bartlett et al. | 343/756 |
| 6,046,702 | A * | 4/2000 | Curtis et al. | 343/776 |
| 6,150,899 | A * | 11/2000 | Seewig et al. | 333/126 |
| 6,388,537 | B1 * | 5/2002 | Matsumoto | 333/21 A |
| 6,522,215 | B2 * | 2/2003 | Enokuma | 333/21 A |
| 7,019,706 | B2 * | 3/2006 | Yoneda et al. | 343/772 |
| 8,022,788 | B2 * | 9/2011 | Sarasa | 333/135 |

FOREIGN PATENT DOCUMENTS

EP 0 987 786 3/2000

OTHER PUBLICATIONS

International Search Report issued Jul. 2, 2010 in International (PCT) Application No. PCT/ES2010/070192.

* cited by examiner

*Primary Examiner* — Benny Lee
(74) *Attorney, Agent, or Firm* — Wenderoth, Lind & Ponack, L.L.P.

(57) ABSTRACT

The invention relates to a cross polarization multiplexer which doubles the capacity of radio links using a vertical polarization diplexer, a horizontal polarization diplexer and an octagonal transducer module for separating the vertically polarized waves from the horizontally polarized waves. The invention is characterized in that the vertical diplexer and the horizontal diplexer are integrated in a module forming a monoblock body having a specific, simple and inexpensive configuration. This configuration allows the use a single transceiver unit which also provides a cost saving.

11 Claims, 4 Drawing Sheets

PRIOR ART- FIG. 1

CROSS POLARIZATION MULTIPLEXER FORMED IN A MONOBLOCK BODY

This application is a continuation of International Application PCT/ES2010/070192, filed Mar. 30, 2010, which is hereby incorporated by reference in its entirety.

OBJECT OF THE INVENTION

The invention relates to a cross polarization multiplexer intended to double the capacity of radio links, for which simultaneously works with vertical polarization waves and horizontal polarization waves; and which is intended to obtain a cross polarization multiplexer formed by a monoblock body that integrates a vertical polarization diplexer, a horizontal polarization diplexer and an orthogonal mode transducer (OMT) that performs the separation of vertically polarized waves from the horizontally polarized waves, providing a specific, simple and inexpensive structure.

Therefore, the invention is applied to the field of telecommunications, and more specifically to the radio links.

BACKGROUND OF THE INVENTION

Currently, radio links are widely used for accessing the wireless LAN or mobile phone base stations, as an easy solution to be implemented and at a competitive cost.

However, the telecommunications market calls for a continuous increase of its capacities and lower costs.

This increase in the requested capacities is facing the limits of the occupation of the spectra, the existing technologies and the cost that all this involves.

Currently there are three ways to increase the net capacity:

1) To increase the levels of modulation, that causes problems of linearity and sensitivity against the noise. The current limit is in the 256QAM.
2) To increase the bandwidth, which is internationally regulated, and only allows high bandwidth for links from 60 to 80 GHz and at these frequencies the distances of these links are unacceptably short, therefore it is not viable.
3) To double the capacity using two different links, both operating at the same frequency with cross polarizations. This possibility is rarely used by being very complex and expensive. Regarding this third point, the most used solution consist of coupling a single antenna to two transceiver units (transmitter and receiver), one which works with vertical polarization and one which works with horizontal polarization, through an orthogonal mode transducer module (OMT, Orthogonal Mode Transducer) that separates the vertically polarized waves from the horizontally polarized waves.

The two transceiver units are controlled by a single input control unit known as an In-Door Unit (IDU), which has a very expensive and complex configuration.

Therefore, this solution requires for each of the two terminals that make up a radio link, an IDU, two radio units, an OMT module and an antenna, which is a complex, costly and unreliable device.

The invention doubles the capacity of radio links, in accordance with paragraph 3, only by means of a single transceiver unit with the cross polarization multiplexer included therein and an antenna, which eliminates the need to use a second transceiver unit, the OMT external module and the IDU unit, which considerably simplifies the structure of this type of devices and significantly reduces their cost.

SUMMARY OF THE INVENTION

To achieve the objectives stated above, the invention provides a cross polarization multiplexer which, like those provided in the state of the art, doubles the capacity of radio links by simultaneously working with vertically polarized waves and horizontally polarized waves, using a vertical polarization diplexer, a horizontal polarization diplexer and an orthogonal mode transducer (OMT). The essential novelty of the cross polarization multiplexer is that the vertical diplexer and the horizontal diplexer are integrated with the OMT module forming a monoblock body. For such a purpose, the OMT module includes a square waveguide having an isolation structure between the vertically polarized waves and the horizontally polarized waves, comprising a first input and output window for the vertically polarized waves through which the OMT module is connected to a second window of the vertical diplexer. Additionally, the OMT module is equipped with a third input and output window for the horizontally polarized waves that constitutes the means of connection of a fourth window of the horizontal diplexer. In this structure the first, second, third and fourth windows are inaccessible from outside the monoblock body which provides a compact and inexpensive structure. Additionally, the OMT module is equipped with a fifth window through which it is connected to an antenna.

Both the vertical diplexer and the horizontal diplexer have a sixth and seventh window for connection to the board that contains, among other circuits, the transmitter circuit and the receiver circuit of the radio unit; so that the sixth and seventh windows, as well as the fifth window for connecting to the antenna of the OMT module, are located on the same plane and they are the only external access to the monoblock body. Such monoblock body is covered by a closure and protective cover which is common to the OMT module and the horizontal and vertical diplexers, and has a flat configuration wherein this cover has apertures in correspondence with the fifth, sixth and seventh windows, so that these apertures are located in a same plane, allowing an easy interface with the board that contains the transceiver circuit.

In the preferred embodiment of the invention, the outer portion of the cover includes some channelings that make up a mask for removing the radiations of millimeter waves radiated from the board that contains the transceiver circuit. To this end, a circuit board is coupled over the cover, forming a single assembly.

The configuration described provides a monoblock body of compact and simple structure which implies an important cost reduction compared to those devices described in the state of the art.

The waveguide of the OMT module includes the fifth window at its top for connecting to the antenna connection, and includes some asymmetrical steps, against which the first input and output window for the vertically polarized waves is arranged, and its bottom wherein the steps end, comprises the third input and output window for the horizontally polarized waves. In the configuration described, the first and third windows are arranged in directions that form an angle of 90° to obtain the necessary isolation that avoids cross-influences between the of vertical and horizontal polarization diplexers, thus achieving the correct transmission and reception of polarized waves.

In addition, the third input and output window for the horizontally polarized waves of the OMT module has a rectangular configuration and is connected to an double-curve waveguide adapting unit connected to the fourth window of the horizontal diplexer, so that this connection is inaccessible from the outside, which allows obtaining the compact monoblock body.

The first input and output window for the vertically polarized waves of the OMT module, has a rectangular configuration which coincides with the second window of the vertical diplexer.

Regarding the configuration of the fifth window of the cover, it should be noted that it has a square or circular configuration in order to perform the connection to the antenna.

In connection with the sixth and seventh windows, it should be noted that these windows may have different configurations, such as rectangular, square, circular or elliptical.

The filters usually included in the diplexers are tuned to the same frequency band, so that those in one side are tuned on the low frequency band and those on the opposite side to the high frequency band for performing the transmission and reception, or vice versa, according to the configuration of the radio unit.

Next to provide a better understanding of this specification and being an integral part thereof, a series of figures in which the object of the invention has been represented in an illustrative and not limitative manner, is attached.

BRIEF DESCRIPTION OF THE FIGURES

FIG. 2 also shows the coupling of the cross polarization multiplexer with a board that contains, among other circuits, the transmitter circuit and the receiver circuit of the radio unit.

DETAILED DESCRIPTION OF THE PREFERRED EMBODIMENTS

A description of the invention based on the figures mentioned above is made below.

Figure 1:
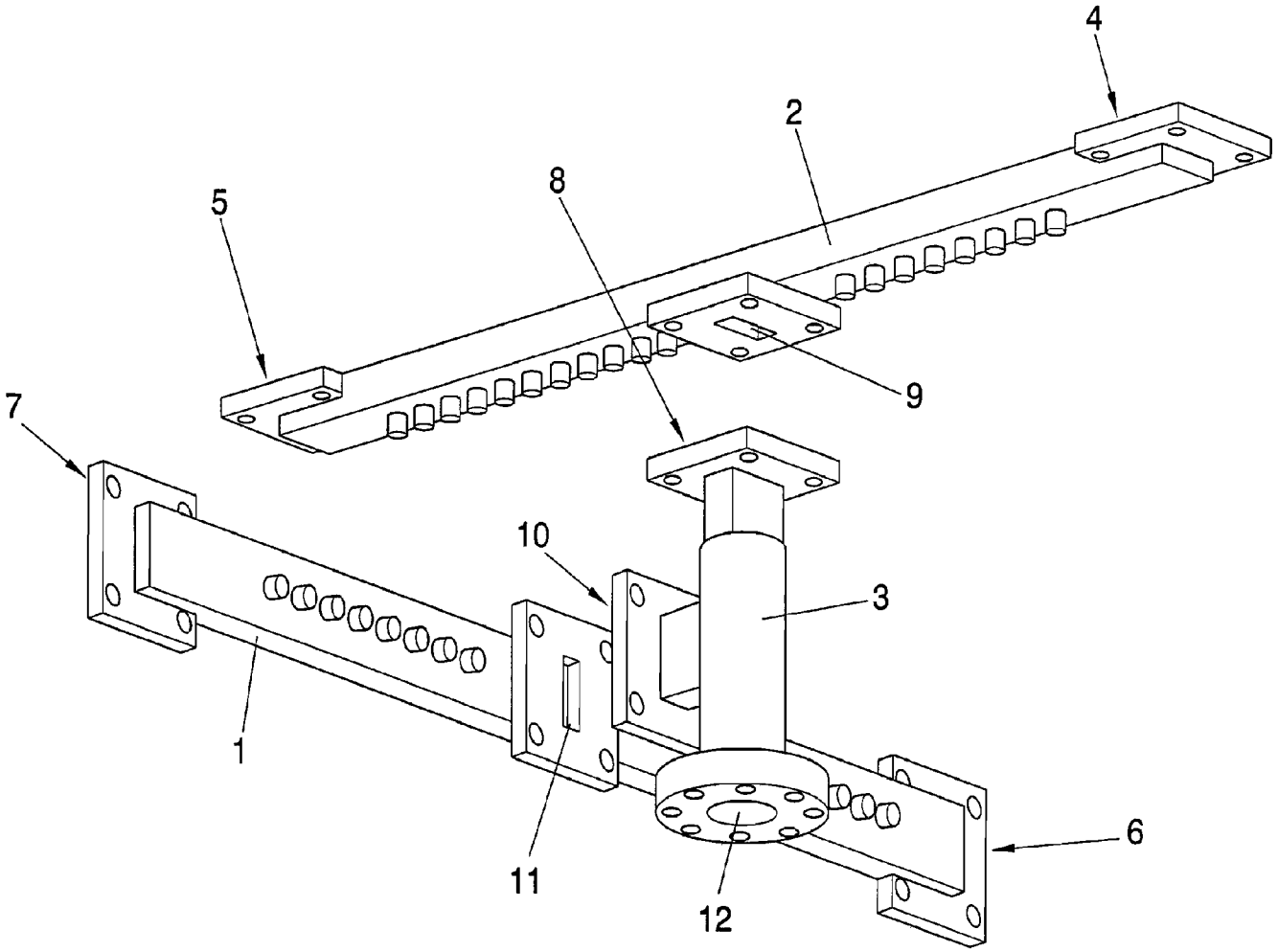
FIG. 1. —Shows a perspective view of the state of the art closest to the invention which has been shown to clearly establish the differences of the state of the art against the invention.

Firstly and with the help of FIG. 1 the current state of the art is described in order to facilitate the understanding of the novelty of the invention.

The prior art shows the connection of a single antenna, through an OMT module (3), with two radio units that work with cross polarization. In FIG. 1 and to facilitate the understanding, only the diplexers integrated into each of the radio unit are shown, by being the connecting elements to the outside for both the reception and transmission of vertically polarized waves and horizontally polarized waves.

The prior art in FIG. 1 shows a vertical polarization diplexer (1) that belongs to the radio unit that transmits and receives vertically polarized waves through windows (6) and (7).

It also comprises a horizontal polarization diplexer (2) that belongs to the radio unit that transmits and receives horizontally polarized waves through windows (4) and (5).

Both diplexers (1) and (2) are connected to the orthogonal mode transducer module OMT (3) that is responsible for separating the vertically polarized waves from the horizontally polarized waves. For such purpose, the vertical polarization diplexer is equipped with an input and output window (11) that is connected to an input and output window (10) of the OMT module (3); and the horizontal polarization diplexer (2) is equipped with an input and output window (9) connected to an input and output window (8) of the referred OMT module (3).

The configuration described in FIG. 1 is completed with the addition of an input and output window (12) of the OMT module (3) through which the connection to an antenna that transmits and receives vertically polarized waves and horizontally polarized waves is made. This technical feature doubles the capacity of the radio link, for which also requires the addition of an entry and control unit (IDU) not shown, which controls the operation of the two radio units. Such solution is complex, costly and unreliable.

Figure 2:
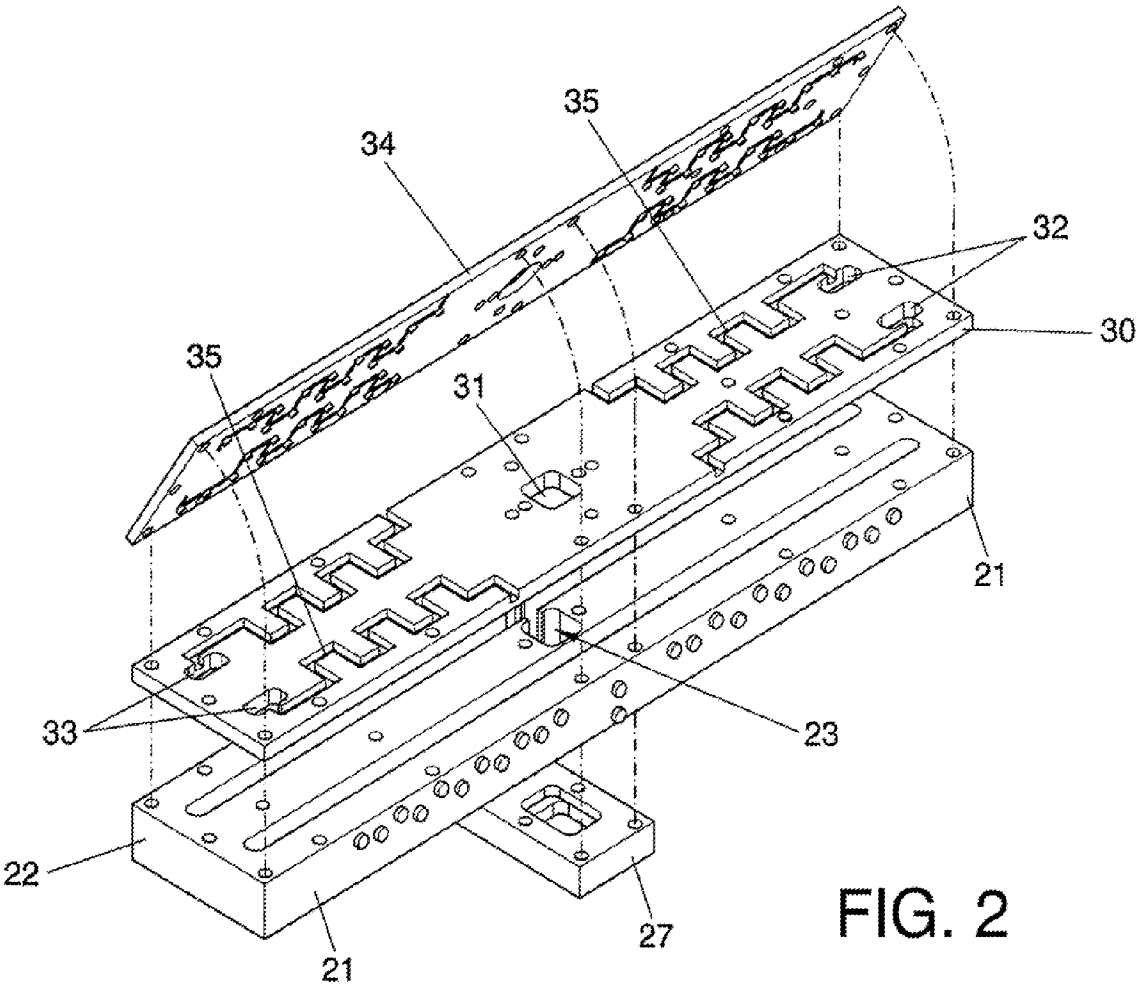
FIG. 2. —Shows an exploded perspective view of the cross polarization multiplexer of the invention.
Figure 4:
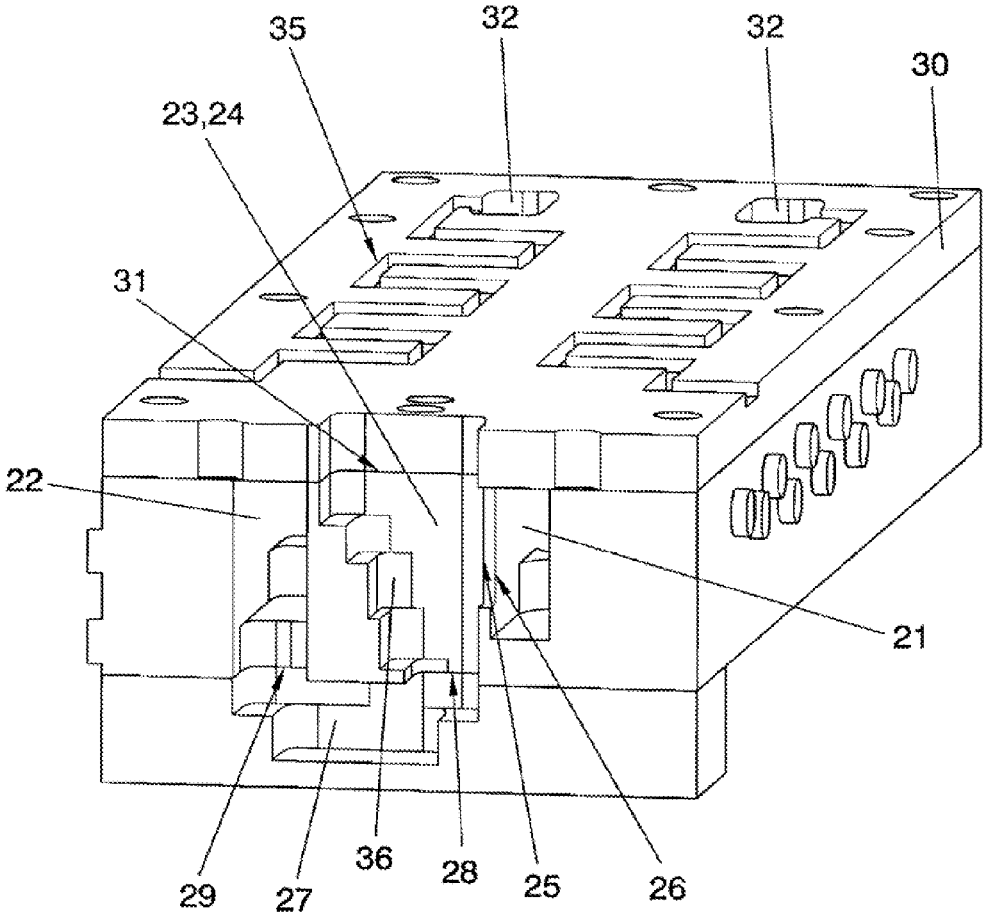
FIG. 4. —Shows a cross-sectional view of FIG. 2 without the circuit board that contains the transmitter circuit and the receiver circuit, with its elements mounted.

The invention of the cross polarization multiplexer, provides a very low cost solution, FIGS. 2 and 4, which presents the peculiarity that the vertical polarization diplexer (21), the horizontal polarization diplexer (22) and the OMT module (23) are integrated forming a monoblock body.

For such purpose, the OMT module (23) comprises, as shown in FIG. 4, a square waveguide (24) that includes a first input and output window (25) for the vertically polarized waves, through which the connection to the vertical polarization diplexer (21) is made. The connection being made through a second window (26) contained in the vertical polarization diplexer (21).

To perform the connection of the OMT module (23) to the horizontal diplexer (22), as shown in FIG. 4, a double-curve waveguide adapting unit (27) is provided, which connects a third input and output window (28) for the horizontally polarized waves of the OMT module (23) to a fourth window (29) of the horizontal polarization diplexer (22).

The OMT module (23) comprises four asymmetrical steps (36), as shown in FIG. 4, through which the horizontally polarized waves contained in the square waveguide (24), are guided through the third input and output window (28) to the double-curve waveguide adapting unit (27), through which the fourth window (29) of the horizontal polarization diplexer (22) is reached.

The second window (26) of the vertical diplexer (21) is situated opposite to the asymmetrical steps (36) in order to direct the vertically polarized waves to the vertical polarization diplexer (21).

Therefore, the first window (25) and the third window (28) of the OMT module (23) are arranged in directions forming an angle of 90° which allows obtaining the proper isolation and thus, avoiding the appearance of inter-influences between the vertical (21) and horizontal (22) polarization diplexers. These inter-influences are distortions in the vertical polarization signal due to the existence of the horizontal polarization signal and vice versa.

The first input and output window (25) has a rectangular configuration and is coincident with the second window (26) of the vertical polarization diplexer (21).

The monoblock body has a flat cover (30) for closure and protection, which is common to the OMT module (23) and to the horizontal (22) and vertical (21) polarization diplexers. The cover (30) comprises a fifth window (31) which is part of the OMT module (23) through which the connection to the antenna, not shown in the figures, is made.

The fifth window (31) has a square or circular configuration.

In addition, the cover (30) is equipped with a sixth window (32) and a seventh window (33), as shown in FIG. 4, that are part of the vertical polarization diplexer (21) and the horizontal polarization diplexer (22), and which constitutes the means of connection to a board (34) as shown in FIG. 2, the board containing, among others, the transmitter circuit and the receiver circuit of the radio unit.

The sixth window (32) and the seventh window (33) have a rectangular, square, circular or elliptical configuration.

The cover (30) has a flat configuration that allows an easy connection interface to the board (34) that contains the transmitter circuit and the receiver circuit.

The described configuration allows obtaining the monoblock body by machining from one of its side and which is closed with the cover (30), which results in high strength, very low cost and high reliability.

The cover (30), besides being a means for closing and protecting the monoblock body, serves as a protection against radiation of millimeter waves irradiated in the board (34). For such purpose, on the outside of the cover (30) holes and channelings (35) are machined to eliminate the radiation of millimeter waves irradiated in the board (34).

Figure 3:
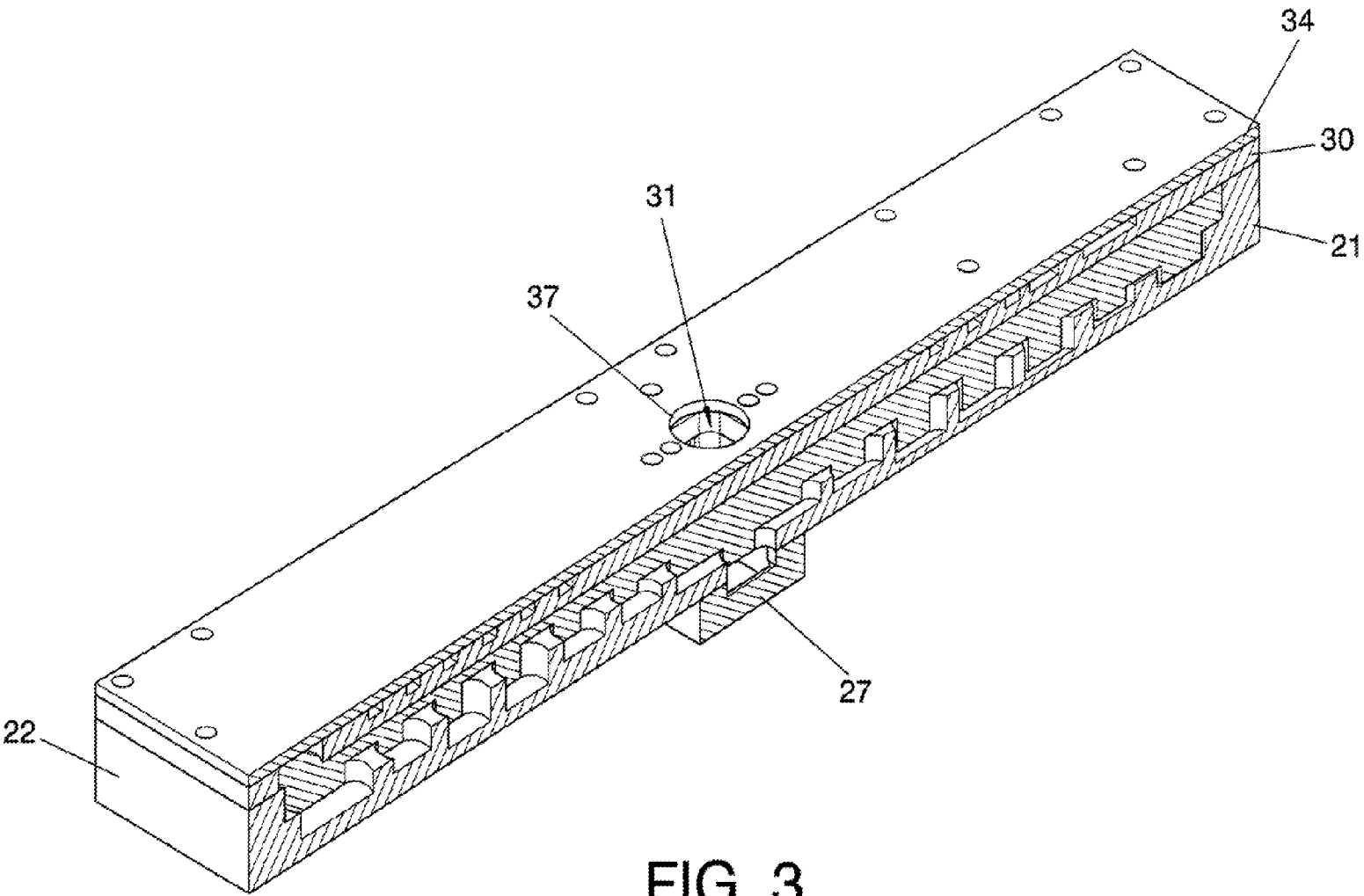
FIG. 3. —Shows a view along a longitudinal section of the multiplexer of FIG. 2 but with its elements mounted.

Therefore, the board (34) containing the transmitter and receiver circuit is directly coupled over the cover (30) forming a single compact and simple assembly, FIG. 3.

The board (34) containing the transmitter and receiver circuit comprises a window (37) through which the connection of the fifth window (31) to the antenna is made.

Therefore, the described structure has a compact monoblock configuration, which comprises the horizontal polarization diplexer (22), the vertical polarization diplexer (21) and the double-curve adapting unit (27), that only require the use of a single transceiver radio unit in order to simultaneously work with vertically polarized waves and horizontally polarized waves, doubling the capacity of radio links, simplifying the structure of the installation, and reducing the cost in a very significantly manner and increasing the reliability of the link.

The invention claimed is:

1. A cross polarization multiplexer, which doubles a capacity of radio links by simultaneously working with vertically polarized waves and horizontally polarized waves, the cross polarization multiplexer comprising:

a vertical polarization diplexer;

a horizontal polarization diplexer; and an orthogonal mode transducer module (OMT) for separating the vertically polarized waves from the horizontally polarized waves, wherein the vertical polarization diplexer and the horizontal polarization diplexer are integrated with the OMT module forming a monoblock body, wherein the OMT module includes a square waveguide having a stepped isolation structure for separating the vertically polarized waves from the horizontally polarized waves, wherein the square waveguide includes:

a first input and output window for guiding the vertically polarized waves, the first input and output window being connected to a second window included in the vertical polarization diplexer; and a third input and output window for guiding the horizontally polarized waves, the third input and output window being connected to a fourth window included in the horizontal polarization diplexer, wherein the first input and output window, the second window, the third input and output window, and the fourth window are inaccessible from outside the monoblock body, wherein the OMT module includes a fifth window for connecting to an antenna, wherein the vertical polarization diplexer and the horizontal polarization diplexer are connected to a single board which contains a transmitter circuit and a receiver circuit, wherein each of the vertical polarization diplexer and the horizontal polarization diplexer includes a sixth window and a seventh window respectively for connecting to the single board containing the transmitter circuit and receiver circuit, and wherein the fifth window for connecting to the antenna of the OMT module, the sixth window, and the seventh window are arranged in a same plane constituting an external access to the monoblock body.

2. The cross polarization multiplexer of claim 1, wherein the square waveguide of the OMT module includes, at a top side of the OMT module, the fifth window for connecting to the antenna, and includes asymmetric steps, against which the first input and output window for the vertically polarized waves is arranged, and at a bottom side of the OMT module, wherein an end of the asymmetric steps includes the third input and output window for the horizontally polarized wave, and wherein the first input and output window and the third input and output window are arranged to form an angle of 90° in order to avoid the appearance of inter-influence between waves transmitted through the vertical polarization diplexer and the horizontal polarization diplexer.

3. The cross polarization multiplexer of claim 2, wherein the third input and output window for the horizontally polarized waves of the OMT module is rectangular and connected to a double-curve waveguide adapting unit connected to the fourth window of the horizontal polarization diplexer, where this connection is inaccessible from outside the monoblock body.

4. The cross polarization multiplexer of claim 3, wherein the first input and output window for the vertically polarized waves of the OMT module is rectangular and coincident with the second window of the vertical polarization diplexer.

5. The cross polarization multiplexer of claim 1, wherein the monoblock body is provided with a closure and protection cover common to the OMT module, the vertical polarization diplexer, and the horizontal polarization diplexer, and wherein the cover includes the fifth window, the sixth window, and the seventh window.

6. The cross polarization multiplexer of claim 5, wherein an external portion of the cover includes channelings that eliminate millimeter radiations radiated by the single board, and wherein the single board is coupled over the cover forming a single assembly.

7. The cross polarization multiplexer of claim 5, wherein the fifth window of the cover has a configuration selected from square and circular for connecting to the antenna, wherein the sixth window and the seventh window of the cover have a configuration selected from rectangular, square, circular and elliptical, and wherein the cover has a planar configuration so that the fifth window, the sixth window, and the seventh window are in one plane.

8. The cross polarization multiplexer of claim 5, wherein the fifth window of the cover has a configuration selected from square and circular for connecting to the antenna.

9. The cross polarization multiplexer of claim 8, wherein the cover has a planar configuration so that the fifth window, the sixth window, and the seventh window are in one plane.

10. The cross polarization multiplexer of claim 5, wherein the sixth window and seventh window of the cover have a configuration selected from rectangular, square, circular and elliptical.

11. The cross polarization multiplexer of claim 10, wherein the cover has a planar configuration so that the fifth window, the sixth window, and the seventh window are in one plane.

* * * * *